US012338615B2

(12) United States Patent
Maniaci

(10) Patent No.: US 12,338,615 B2
(45) Date of Patent: Jun. 24, 2025

(54) BIDET DEVICE

(71) Applicant: UEP CLEAR REAR LLC, Austin, TX (US)

(72) Inventor: Giancarlo Maniaci, Villa Park, CA (US)

( * ) Notice: Subject to any disclaimer, the term of this patent is extended or adjusted under 35 U.S.C. 154(b) by 359 days.

(21) Appl. No.: 17/819,310

(22) Filed: Aug. 12, 2022

(65) Prior Publication Data

US 2023/0046125 A1 Feb. 16, 2023

Related U.S. Application Data

(60) Provisional application No. 63/232,547, filed on Aug. 12, 2021.

(51) Int. Cl.
*E03D 9/08* (2006.01)
*E03D 9/00* (2006.01)

(52) U.S. Cl.
CPC ..... *E03D 9/08* (2013.01); *E03D 9/005* (2013.01)

(58) Field of Classification Search
CPC ..... E03D 9/08; E03D 9/005
See application file for complete search history.

(56) References Cited

U.S. PATENT DOCUMENTS

| | | | | |
|---|---|---|---|---|
| 3,256,531 | A | 6/1966 | Arensberg | |
| 3,430,267 | A | 3/1969 | Houten | |
| 4,807,311 | A | 2/1989 | Ingels | |
| 11,286,656 | B1 * | 3/2022 | Mesadieu | E03D 9/005 |
| 11,499,304 | B1 * | 11/2022 | Bensing | F16K 11/08 |
| 2013/0292003 | A1 * | 11/2013 | Sawalski | E03D 9/032 141/311 R |
| 2018/0209129 | A1 * | 7/2018 | He | E03D 9/08 |
| 2020/0318334 | A1 * | 10/2020 | Gupta | E03D 9/08 |

* cited by examiner

*Primary Examiner* — Christine J Skubinna
(74) *Attorney, Agent, or Firm* — Stovall Legal, PLLC; Blake D. Stovall

(57) ABSTRACT

A bidet device for attachment to a toilet. The bidet device includes a water inlet configured to be connected to a water supply line, a liquid inlet configured to be connected to a container for containing a liquid, a liquid nozzle for spraying the liquid into the toilet, and a wash nozzle for spraying water so as to wash a user's body part. The liquid nozzle is fluidly connected to the liquid inlet. The wash nozzle is fluidly connected to the water inlet.

21 Claims, 11 Drawing Sheets

BIDET DEVICE

RELATED APPLICATIONS

This application claims the priority benefit of U.S. Provisional Patent Application No. 63/232,547 filed Aug. 12, 2021.

TECHNICAL FIELD

The present disclosure generally relates to a bidet device, and more particularly to a bidet device for attachment to a toilet.

BACKGROUND

A bidet is a device that uses a stream of water to wash a person's genital and anal regions. Bidets can reduce the need for toilet paper. Some bidets are designed to attach directly to an existing toilet.

BRIEF DESCRIPTION OF THE DRAWINGS

Various ones of the appended drawings merely illustrate example embodiments of the present disclosure and should not be considered as limiting its scope.

DETAILED DESCRIPTION

Embodiments of the present disclosure can provide a bidet device that is capable of blocking odors and cleaning the toilet bowl. For example, a user can press a button on the bidet to dispense a deodorizing solution onto a surface of the water in the toilet. As such, a user can prevent unpleasant odors from invading the air, without having to locate a separate deodorizing product. In addition, a user can press a button on the bidet to spray a cleaning solution around the toilet bowl. This allows the user to conveniently clean the toilet after each use to help prevent the build-up of stains and mold.

The present disclosure provides a bidet device for attachment to a toilet. According to an exemplary embodiment, the bidet device includes a water inlet configured to be connected to a water supply line. The bidet device further includes a liquid inlet configured to be connected to a container for containing a liquid. The bidet device further includes a liquid nozzle for spraying the liquid into the toilet. The liquid nozzle is fluidly connected to the liquid inlet. The bidet device further includes a wash nozzle for spraying water so as to wash a user's body part. The wash nozzle is fluidly connected to the water inlet.

In the above embodiment, the liquid can be a deodorizing liquid or a cleaning liquid. The bidet device can include a plurality of nozzles for spraying the liquid into the toilet, the plurality of nozzles being arranged in a circular pattern. The bidet device can include a first liquid inlet configured to be connected to a first container containing a first liquid, and a second liquid inlet configured to be connected to a second container containing a second liquid. The first liquid inlet can be fluidly connected to a first liquid nozzle for spraying the first liquid into the toilet. The second liquid inlet can be fluidly connected to a second liquid nozzle for spraying the second liquid into the toilet. The bidet device can include a cylindrical portion with a plurality of nozzles arranged around a circumference thereof. The plurality of nozzles can be configured to spray the second liquid into the toilet. The first liquid nozzle can extend from a base of the cylindrical portion. The first liquid can be a deodorizing liquid, and the second liquid can be a cleaning liquid. The bidet device can further include a button for causing the solution nozzle to spray the solution into the toilet. The bidet device can include a front wash nozzle and a rear wash nozzle.

Figure 1:
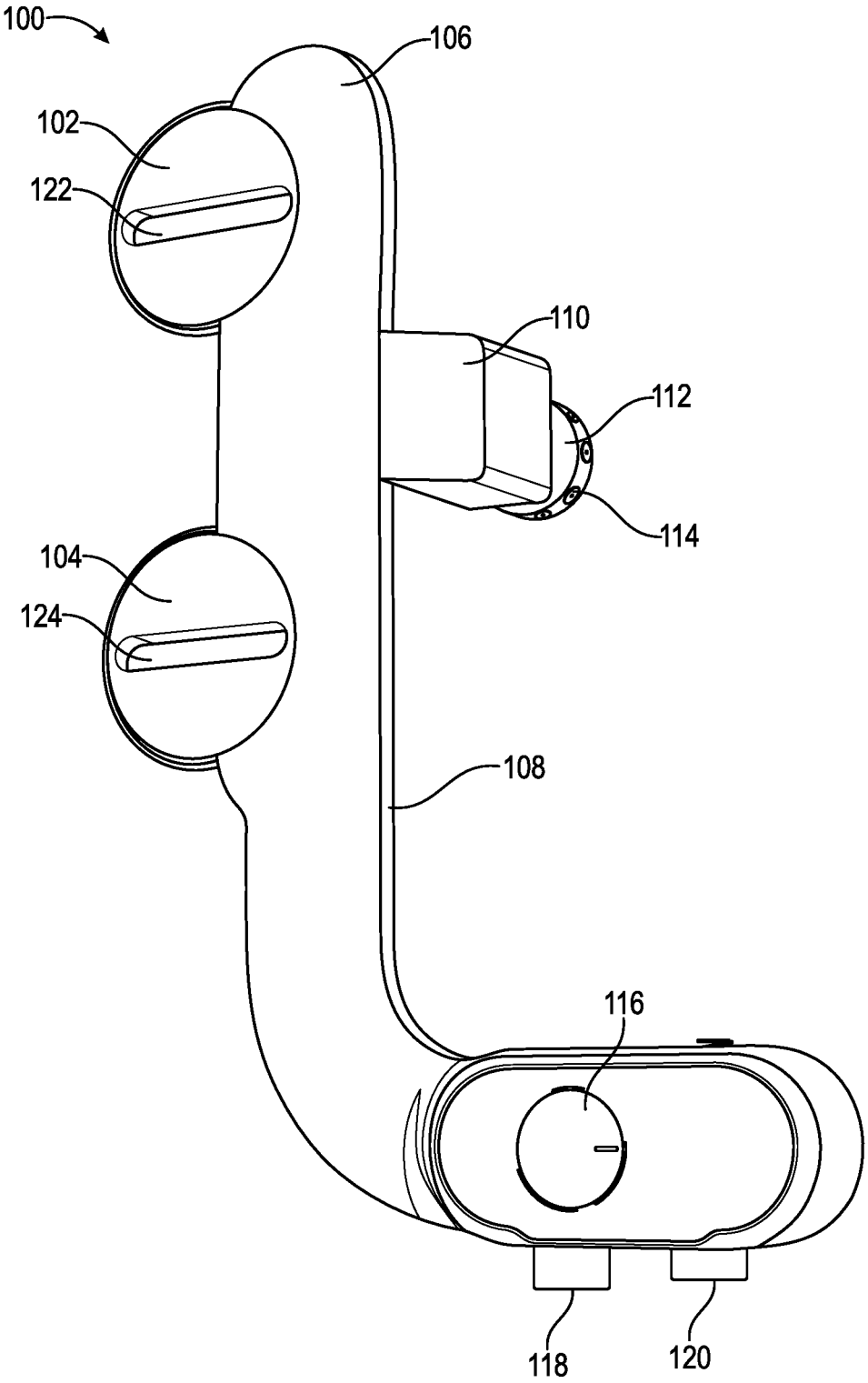
FIG. 1 is a perspective view of a bidet device according to an example embodiment.

Turning to the figures, FIG. 1 shows a bidet device 100 according to an example embodiment. The bidet device 100 includes rotatable adjustable plate 102 and rotatable adjustable plate 104. The adjustable plates include slots 122 and 124, respectively, through which mounting bolts can pass for attachment to a toilet. The bidet device includes a top cover 106, an L-shaped skeleton 108, and a nozzle housing 110. A dial 116 is used to control the bidet.

Button 118 can be pressed by a user to spray a cleaning liquid into the toilet. Button 120 can be pressed by a user to spray a deodorizing liquid into the toilet. The bidet device 100 further includes a cylindrical portion 112 with nozzles 114, through which a cleaning solution is sprayed into the toilet. The bidet device 100 can be mostly made of plastic. For instance, the L-shaped skeleton 108 can be made of plastic.

The deodorizing liquid can be a mixture of essential oils which creates a film on the surface of the water. The protective barrier can trap odors under the water surface. The cleaning liquid can be any conventional chemical solution designed for cleaning a toilet bowl.

Figure 2:
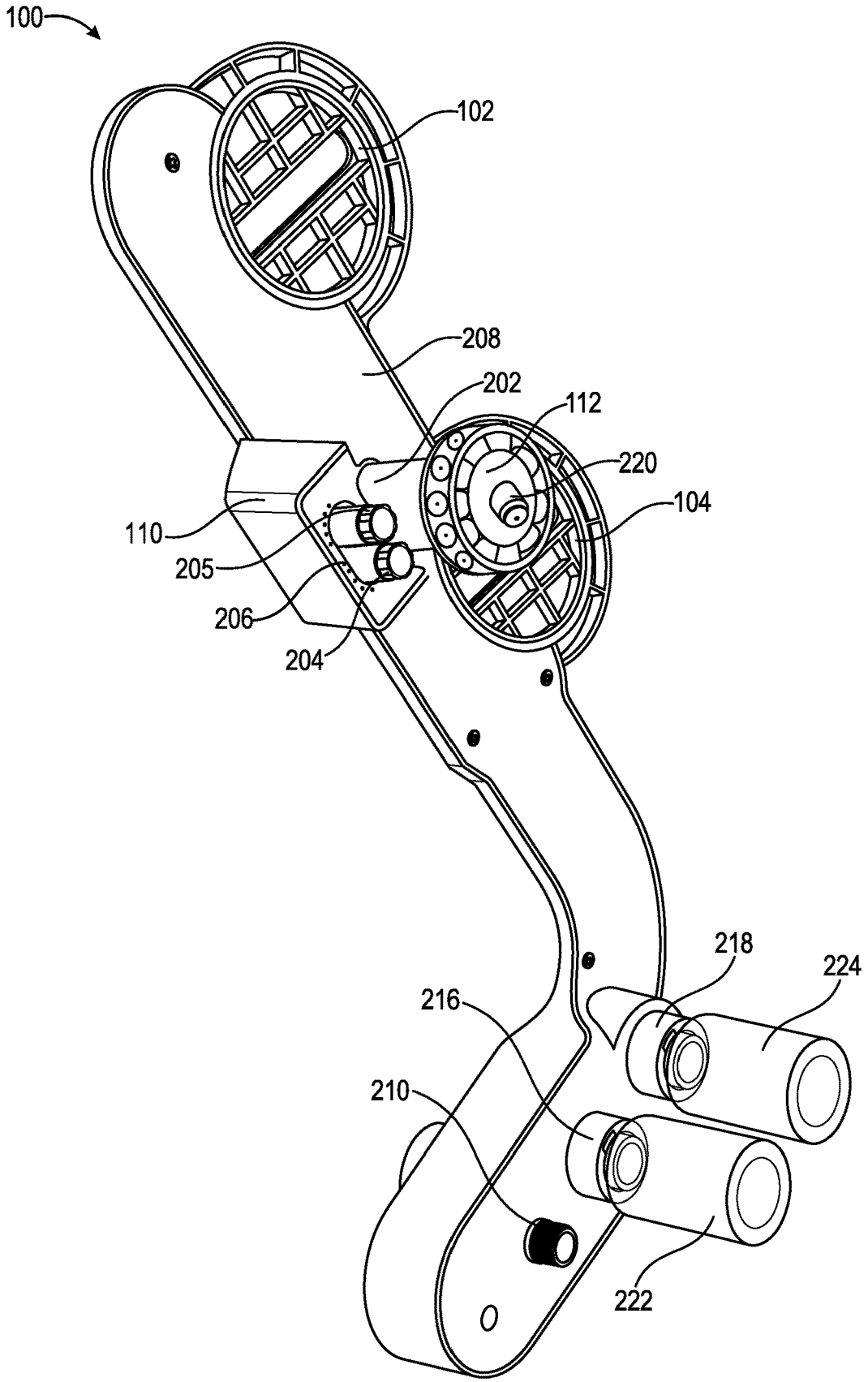
FIG. 2 is a perspective view of a bidet device according to an example embodiment.

FIG. 2 shows an underside of the bidet device 100 (e.g., the side facing downward when attached to a toilet). The bidet device 100 includes a bottom cover 208 which attaches to the top cover 106 by using screws. The bidet device further includes a rear wash nozzle 204 for spraying water at an angle to wash a person's anal region. Also included is a front wash nozzle 205 for spraying water at an angle to wash a user's genitalia, typically female. Each of the rear wash nozzle 204 and the front wash nozzle 205 contain a plurality of holes (not shown) for spraying water.

Also included is a nozzle cleaner 206 for cleaning the rear wash nozzle 204 and the front wash nozzle 205. The nozzle cleaner 206 includes a plurality of holes through which water is squirted downward onto the rear wash nozzle 204 and the front wash nozzle 205 for cleaning.

A nozzle 220 for spraying a deodorizing liquid into the toilet extends from a base of the cylindrical portion 112. The bidet device 100 includes a water inlet 210 for connection to an incoming water line. A container 222 for containing a deodorizing liquid is attached to an inlet 216, and a container 224 for containing a toilet cleaning liquid is attached to an inlet 218. An arm 202 extends downward from the nozzle housing 110 and connects to the cylindrical portion 112.

Figure 3:
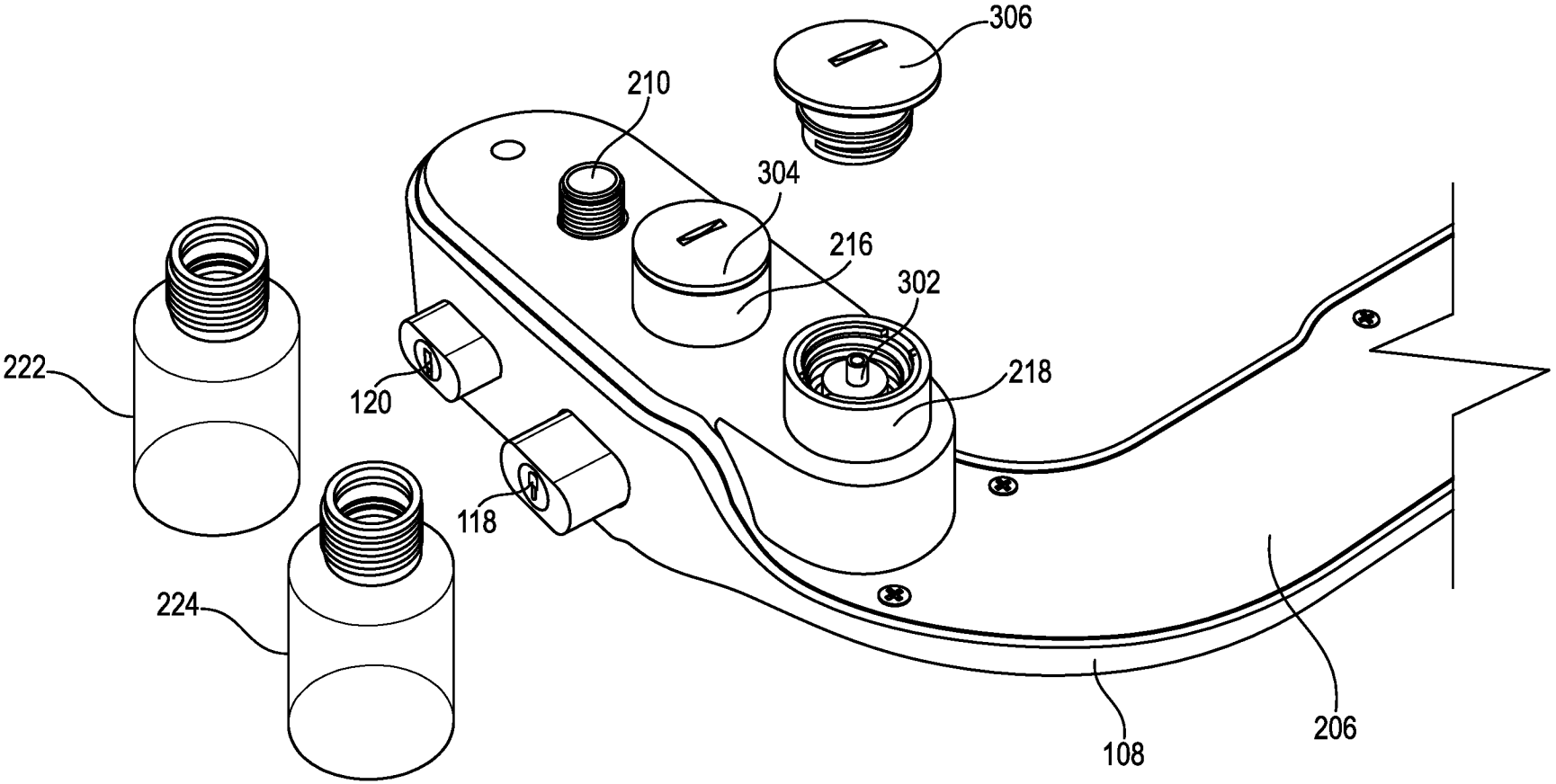
FIG. 3 is a perspective view of a portion of a bidet device according to an example embodiment.

FIG. 3 shows a portion of the underside of the bidet device 100. A cap 304 is used to cover the inlet 216 when not connected to the container 222. A cap 306 is used to cover the inlet 218 when not connected to the container 224. Each of the inlets 216 and 218 includes an orifice 302 through which liquid moves or flows from the container into the bidet.

Figure 4:
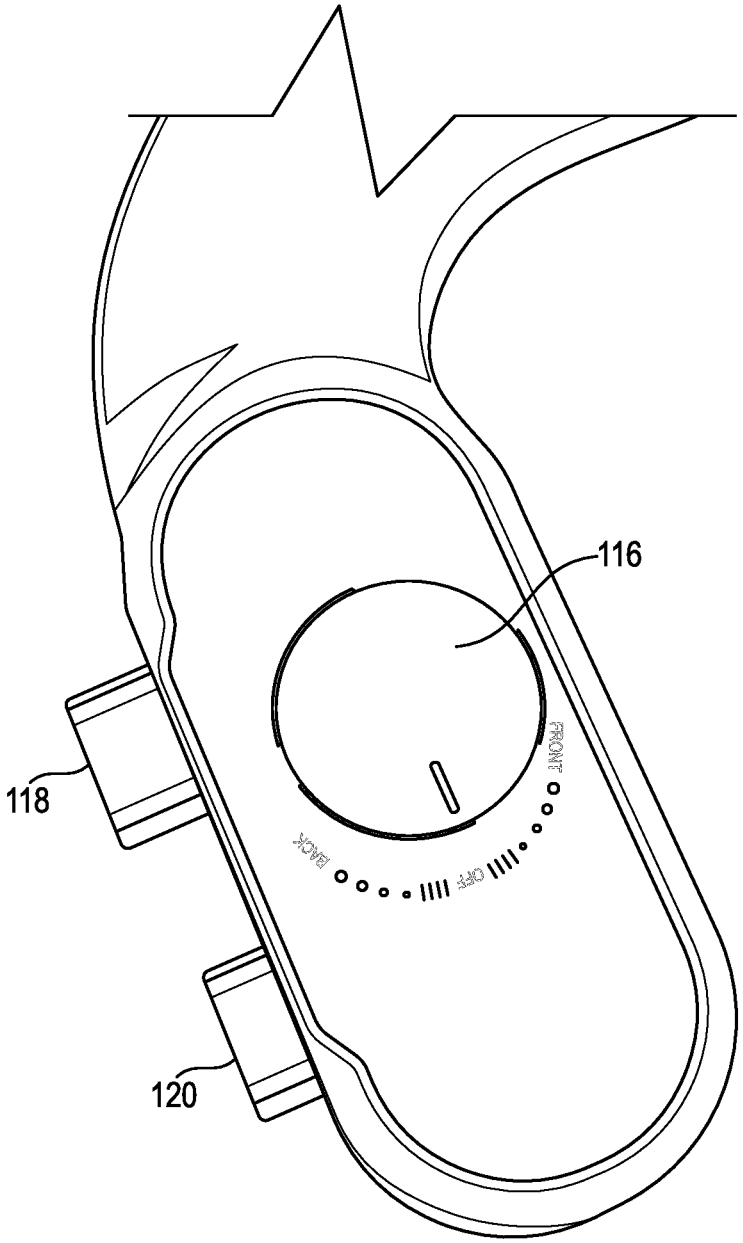
FIG. 4 is a perspective view of a portion of a bidet device according to an example embodiment.

FIG. 4 shows a portion of the bidet device 100 including the dial 116. The vertical line symbols represent a nozzle cleaning function. When the dial 116 is moved from the OFF position to point at the line symbols, the nozzle cleaner 206 sprays water downward onto the rear wash nozzle 204 and the front wash nozzle 205 to clean them. The circle symbols represent progressively increasing water pressure to one of the rear wash nozzle 204 and the front wash nozzle 205. As such, the intensity of the water sprayed from either the rear wash nozzle 204 or the front wash nozzle 205 increases as the dial points to the larger circles. If a user wishes to use the rear wash nozzle 204, the user turns the dial toward the BACK position. If a user wishes to use the front wash nozzle 205, the user turns the dial toward the FRONT position.

Figure 5:
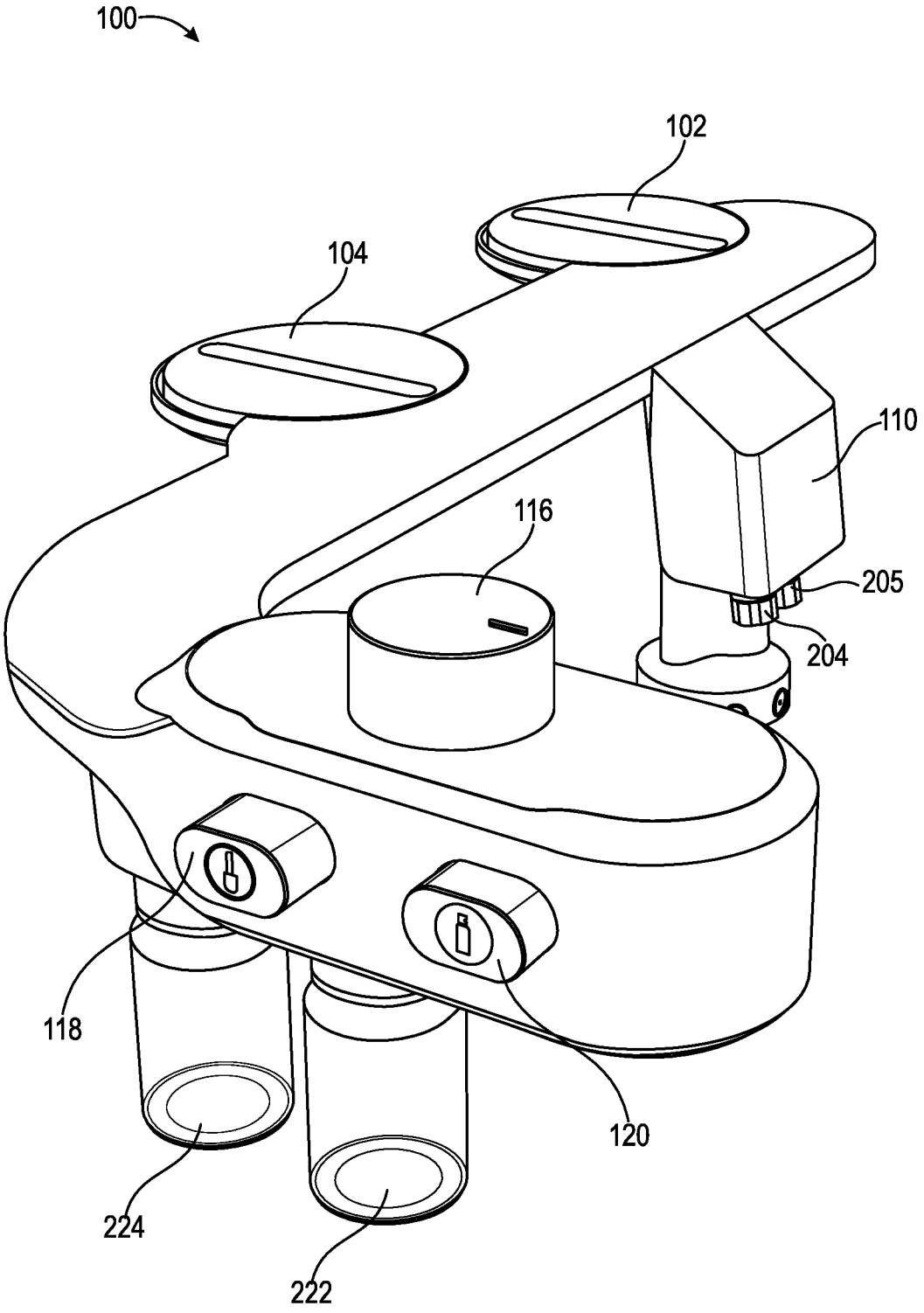
FIG. 5 is a perspective view of a bidet device according to an example embodiment.

FIG. 5 shows another perspective view of the bidet device 100. The bidet device 100 is connected to the container 222, which contains a deodorizing liquid. When the user presses button 120, the deodorizing liquid is dispensed through the nozzle 220. The user may press this button before going to the bathroom, to prevent future unpleasant odors. When the user presses button 118, the toilet cleaning liquid is dispensed through the nozzles 114. The user may press this button after washing with the washing nozzle and flushing the toilet, so as to keep the toilet fresh and to remove any stains.

Figure 6:
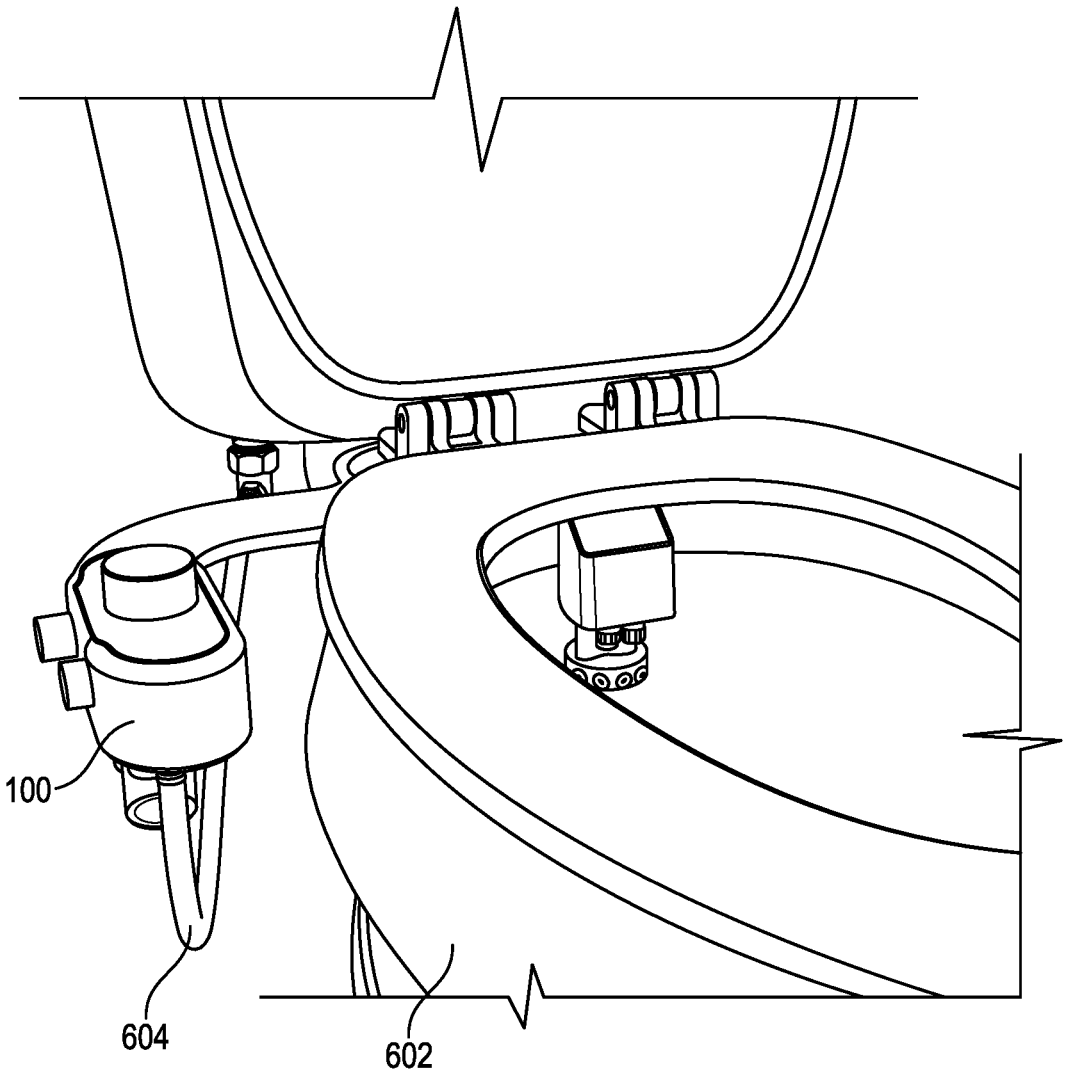
FIG. 6 is a perspective view of a bidet device attached to a toilet, according to an example embodiment.

FIG. 6 shows the bidet device 100 as attached to a toilet 602. The bidet device is attached underneath the toilet seat using the rotatable adjustable plate 102 and the rotatable adjustable plate 104. A bidet hose 604 is attached at one end to the incoming water supply, and at the other end to the water inlet 210. The bidet hose 604 can be a stainless-steel braided hose.

Figure 7:
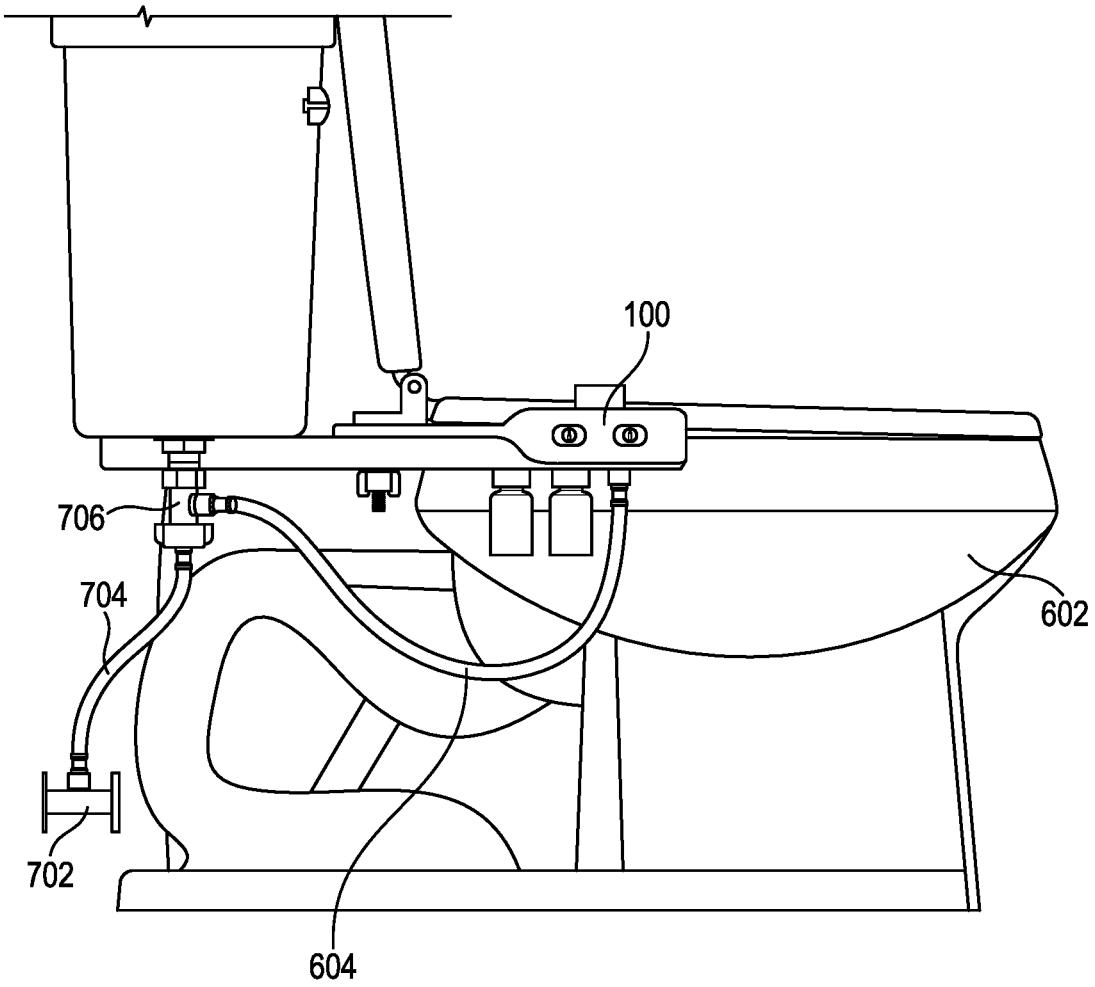
FIG. 7 is a perspective view of a bidet device attached to a toilet, according to an example embodiment.

FIG. 7 shows a side perspective view of the bidet device 100 attached to the toilet 602. The bidet hose 604 is attached to an adaptor 706 which connects to the water supply 702 via a water supply hose 704.

Figure 8:
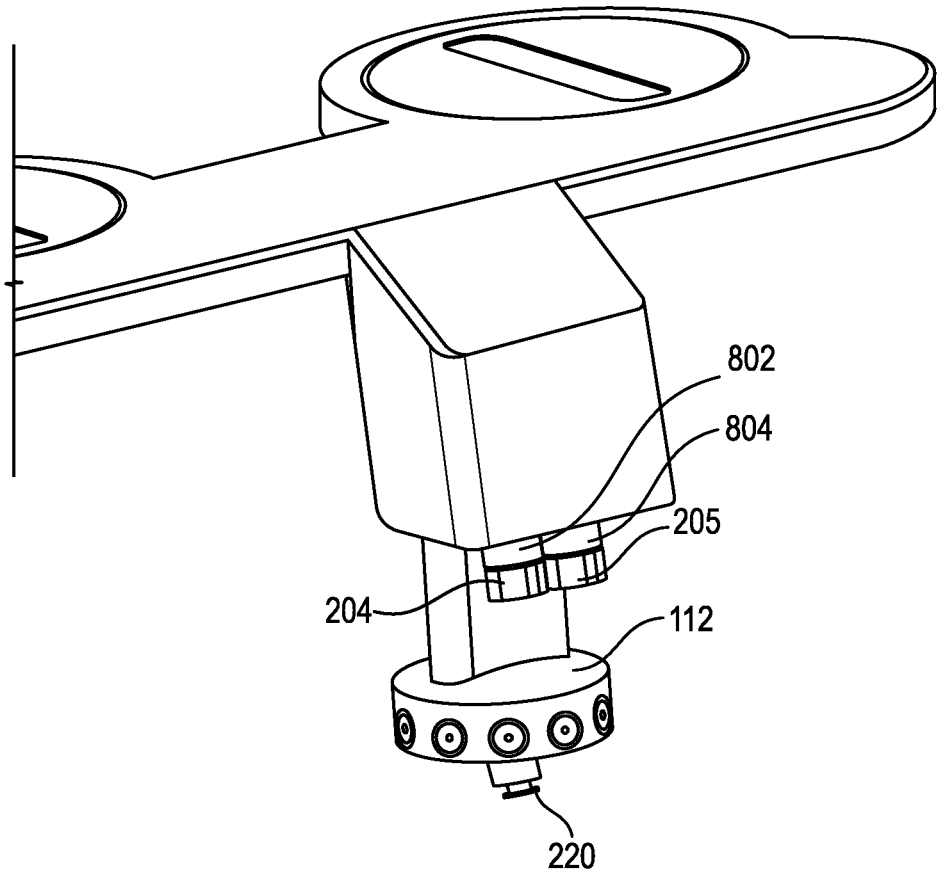
FIG. 8 is a perspective view of a portion of a bidet device according to an example embodiment.

FIG. 8 shows a portion of the bidet device 100. A portion of the rear wash nozzle 204 is contained in a receptacle 802, and a portion of the front wash nozzle 205 is contained in a receptacle 804. When a user moves the dial 116 toward the BACK position, water pressure is applied to the rear wash nozzle 204, causing it to protrude downward out of the receptacle 802. Thus, the rear wash nozzle 204 is able to spray water to wash the anal region of a user.

Likewise, when a user moves the dial 116 toward the FRONT position, water pressure is applied to the front wash nozzle 205, causing it to protrude downward out of the receptacle 804. As such, the front wash nozzle 205 is able to spray water to wash the genitalia region. When the dial 116 is in the OFF position, both the rear wash nozzle 204 and the front wash nozzle 205 are retracted into the receptacles 802 and 804, respectively.

Further, as shown in FIG. 8, the nozzle 220 for spraying the deodorant liquid extends from the bottom of the cylindrical portion 112. The nozzle 220 extends at an angle toward the toilet bowl so as to better administer the deodorant liquid on the surface of the water.

Figure 9:
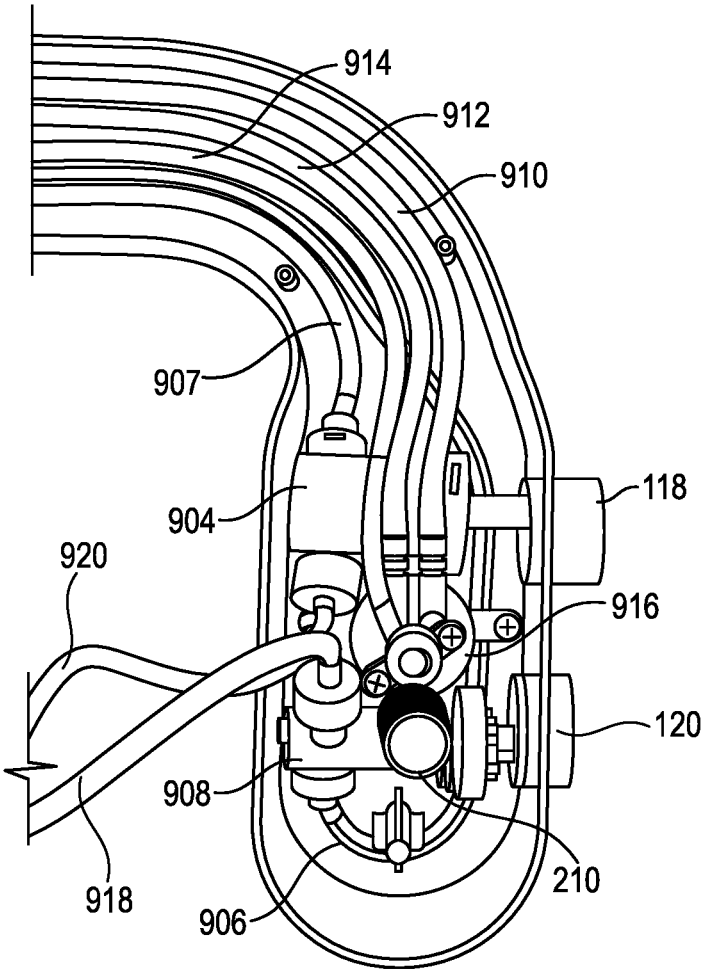
FIG. 9 is a perspective view of a portion of a bidet device according to an example embodiment.

FIG. 9 shows an internal perspective view of a portion of a bidet device according to an example embodiment. When a user presses the button 120, a fluid pump 908 is activated. The fluid pump 908 draws the deodorizing liquid from the container 222 through a tube 918 and into a chamber of the fluid pump 908. The fluid pump 908 then expels the deodorizing liquid from the chamber into the tube 906. The deodorizing liquid travels through the tube 906 to the nozzle 220 where it is sprayed into the toilet.

When the user presses the button 118, a fluid pump 904 is activated. The fluid pump 904 draws the toilet cleaning liquid from the container 224 through the tube 920 and into a chamber of the fluid pump 904. The fluid pump 904 then expels the cleaning liquid from the chamber into the tube 907. The cleaning liquid travels through the tube 907 to the nozzles 114 where it is sprayed into the toilet.

The fluid pump 904 and fluid pump 908 are mechanical, and do not require any electricity. The fluid pump 904 is larger than the fluid pump 908, because the amount of cleaning liquid to feed the plural nozzles 114 is greater than the amount of deodorizing liquid to feed the nozzle 220.

Tubes 910, 912, and 914 are fluidly connected to the water supply via a valve mechanism 916 controlled by the dial 116. One of these tubes is attached to the rear wash nozzle 204, one is attached to the front wash nozzle 205, and one is attached to the nozzle cleaner 206.

Figure 10:
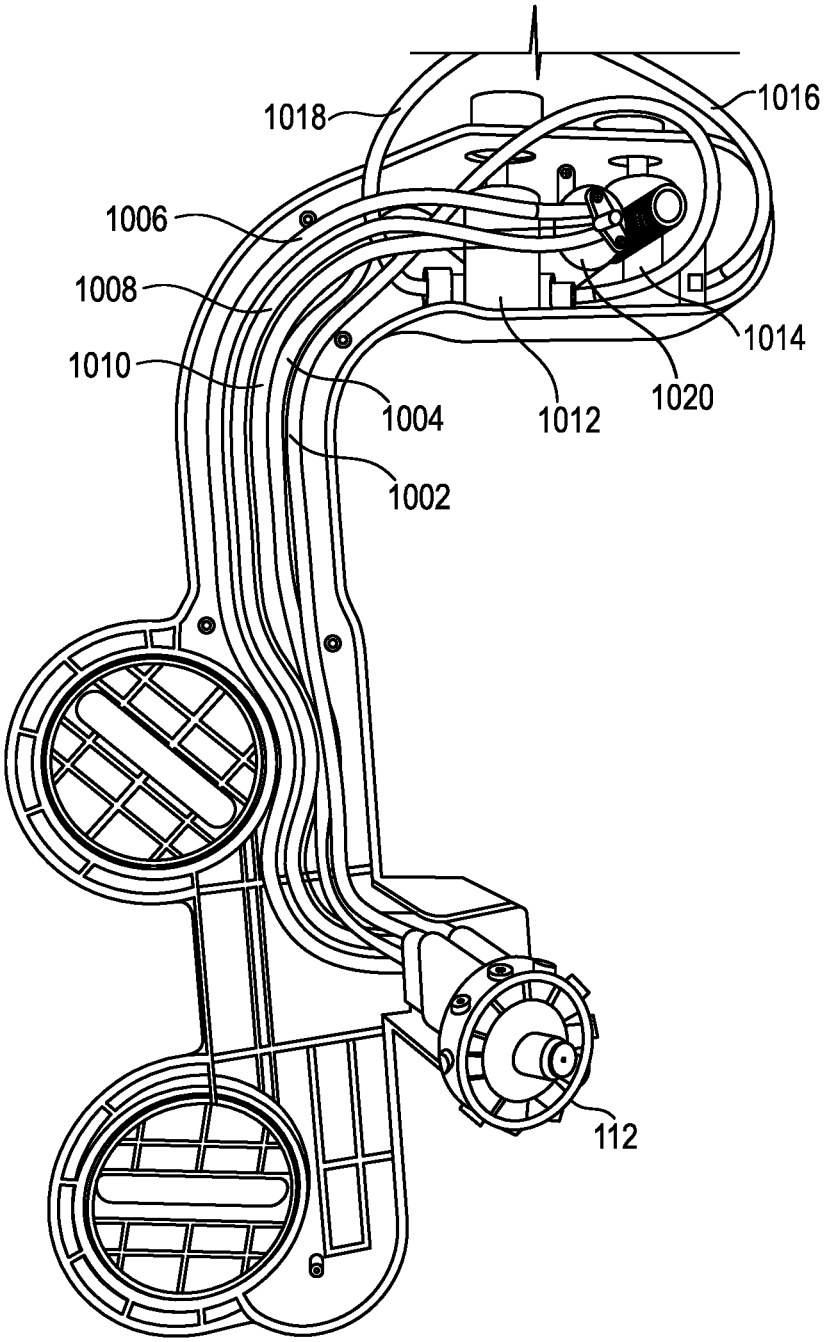
FIG. 10 is a perspective view of a portion of a bidet device according to an example embodiment.

FIG. 10 shows an internal perspective view of a bidet device according to an example embodiment. When a user presses the button 120, a fluid pump 1014 is activated. The fluid pump 1014 is designed to move the deodorizing liquid from the container 222 through a tube 1016 and into the fluid pump 1014. The fluid pump 1014 then expels the deodorizing liquid into a tube 1004. The deodorizing liquid travels through the tube 1004 to the nozzle 220 where it is sprayed into the toilet. Upon connecting a new container 222 full of deodorizing liquid to the inlet 216, it may be necessary for the user to repeatedly press the button 120 to prime the fluid pump 1014 and remove any air in the tubes 1004 and 1016.

When the user presses the button 118, a fluid pump 1012 is activated. The fluid pump 1012 is designed to move the cleaning liquid from the container 224 through the tube 1018 and into the fluid pump 1012. The fluid pump 1012 then expels the cleaning liquid into a tube 1002. The cleaning liquid travels through the tube 1002 to the nozzles 114 where it is sprayed into the toilet. Upon connecting a new container 224 full of cleaning liquid to the inlet 218, it may be necessary for the user to repeatedly press the button 118 to prime the fluid pump 1012 and remove any air in the tubes 1002 and 1018.

Tubes 1006, 1008, and 1010 are fluidly connected to the water supply via a valve mechanism 1020 disposed underneath the dial 116. The valve mechanism 1020 is fluidly connected to the water inlet 210. Tube 1006 is attached to the front wash nozzle 205; tube 1008 is attached to the nozzle cleaner 206; and tube 1010 is attached to the rear wash nozzle 204.

When the dial 116 is in the OFF position, no water passes through any of the tubes 1006, 1008, and 1010. When the dial 116 is moved toward the BACK position and points to the line symbols shown in FIG. 4, water travels from the water inlet 210 through the valve mechanism 1020 and into the tube 1008. The water then flows to the nozzle cleaner 206. Accordingly, water is sprayed from the holes in the nozzle cleaner 206 downward onto the rear wash nozzle 204 and the front wash nozzle 205 to clean them.

When the dial 116 is moved further toward the BACK position and points to the circle symbols shown in FIG. 4, water is allowed to travel from the water inlet 210 through the valve mechanism 1020 and into the tube 1010. The water then flows to the rear wash nozzle 204. Thus, water is sprayed from the holes in the rear wash nozzle 204. The pressure to the rear wash nozzle 204 progressively increases with the increasing size of the circle symbols.

When the dial 116 is moved from the OFF position toward the FRONT position and points to the line symbols shown in FIG. 4, water travels from the water inlet 210 through the valve mechanism 1020 and into the tube 1008. The water then flows to the nozzle cleaner 206. Thus, water is sprayed from the holes in the nozzle cleaner 206 downward onto the rear wash nozzle 204 and the front wash nozzle 205 to clean them.

When the dial 116 is moved further toward the FRONT position and points to the circle symbols shown in FIG. 4, water is allowed to travel from the water inlet 210 through the valve mechanism 1020 and into the tube 1006. The water then flows to the front wash nozzle 205. As such, water is sprayed from the holes in the front wash nozzle 205. The pressure to the front wash nozzle 205 progressively increases with the increasing size of the circle symbols.

The tubing discussed above can be made of a flexible rubber material or a flexible plastic material.

Figure 11:
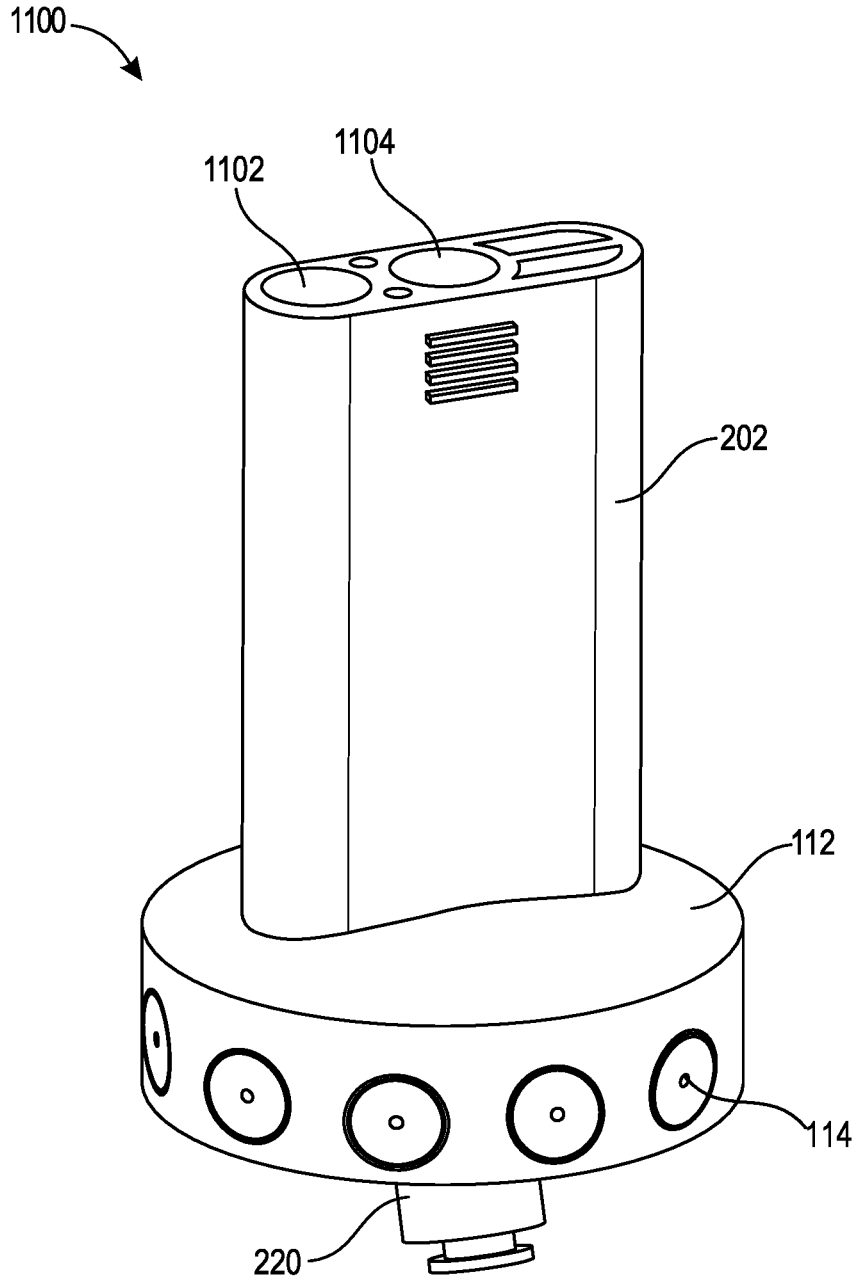
FIG. 11 is a perspective view of a component of a bidet device according to an example embodiment.

FIG. 11 shows a perspective view of a component 1100 of a bidet device according to an example embodiment. The component 1100 contains an arm 202 with a passageway 1102 that is fluidly connected to the nozzles 114. The open end of the passageway 1102 can be connected to a tube for carrying a cleaning solution. Thus, the cleaning solution can move through the passageway 1102 and spray out of the nozzles 114.

The nozzles 114 are arranged around the entire circumference of the cylindrical portion 112 with even spacing. This allows the cleaning solution to be sprayed around the entire inner circumference of the toilet bowl. Improved cleaning of the inside of the toilet can therefore be achieved.

The arm 202 also includes a passageway 1104 fluidly connected to the nozzle 220. The open end of the passageway 1104 can be connected to a tube for carrying a deodorizing solution. As such, the deodorizing solution can move through the passageway 1104 and spray out of the nozzle 220. The nozzle 220 is slightly tilted toward the front of the toilet so as to disperse the deodorizing solution on a surface of the toilet water.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions. For example, it is to be understood that the disclosure contemplates that, to the extent possible, one or more features of any embodiment can be combined with one or more features of any other embodiment.

The invention claimed is:

1. A bidet device for attachment to a toilet, comprising:
- a body;
- a dial for operating the bidet device;
- a nozzle housing extending downwards from the body;
- a water inlet configured to be connected to a water supply line;
- a first wash nozzle extending downwards from the nozzle housing, the first wash nozzle being fluidly connected to the water inlet;
- a second wash nozzle extending downwards from the nozzle housing, the second wash nozzle being fluidly connected to the water inlet;
- a nozzle cleaner configured to spray liquid on the first wash nozzle and second wash nozzle, the nozzle cleaner being fluidly connected to the water inlet, wherein the dial comprises:
  - a first range in a first direction, wherein when the dial is turned within the first range in the first direction the nozzle cleaner is activated;
  - a second range in the first direction, wherein when the dial is turned within the second range in the first direction the first wash nozzle is activated;
  - a first range in a second direction, wherein when the dial is turned within the first range in the second direction the nozzle cleaner is activated; and
  - a second range in the second direction, wherein when the dial is turned within the second range in the second direction, the second wash nozzle is activated.

2. The bidet device of claim 1, wherein the body comprises:
- an L-shaped skeleton;
- a top cover, the top cover comprising a plurality of threaded holes for receiving screws;
- a bottom cover, the bottom cover comprising a plurality of holes corresponding to the plurality of threaded holes; and
- a plurality of adjustable plates, the adjustable plates comprising slots for mounting bolts.

3. The bidet device of claim 1, further comprising a valve coupled to the dial, the valve fluidly connected to the water inlet, the nozzle cleaner, the first wash nozzle, and the second wash nozzle.

4. The bidet device of claim 3,
- wherein when the dial is turned within the first range in the first direction, the valve fluidly connects the water inlet to the nozzle cleaner;
- wherein when the dial is turned within the second range in the first direction, the valve fluidly connects the water inlet to the first wash nozzle;
- wherein when the dial is turned within the first range in the second direction, the valve fluidly connects the water inlet to the nozzle cleaner; and
- wherein when the dial is turned within the second range in the second direction, the valve fluidly connects the water inlet to the second wash nozzle.

5. The bidet device of claim 1, further comprising:
- an arm extending downwards from the nozzle housing; and
- a cylindrical portion attached to the arm, the cylindrical portion comprising a plurality of nozzles spaced around the cylindrical portion;
- a first inlet, the first inlet fluidly connected to the plurality of nozzles; and
- a first container for a first liquid.

6. The bidet device of claim 5, further comprising:
- a pump, the pump fluidly connected to the first inlet and the plurality of nozzles; and
- a button connected to the pump, wherein pressing the button causes the pump to draw the first liquid from the first container and expel the first liquid from the plurality of nozzles.

7. The bidet device of claim 5, further comprising:
- a nozzle extending from a base of the cylindrical portion;
- a second inlet, the second inlet fluidly connected to the plurality of nozzles; and
- a second container for a second liquid.

8. The bidet device of claim 7, further comprising:

a pump, the pump fluidly connected to the second inlet and the nozzle; and a button connected to the pump, wherein pressing the button causes the pump to draw the second liquid from the second container and expel the second liquid from the nozzle.

9. A bidet device for attachment to a toilet, comprising:

a water inlet configured to be connected to a water supply line;

a first liquid inlet configured to be connected to a first container for containing a first liquid;

a plurality of nozzles for spraying the first liquid into the toilet, wherein the plurality of nozzles are fluidly connected to the first liquid inlet and arranged in a circular pattern;

a first wash nozzle for spraying water so as to wash a user's first body part, the first wash nozzle being fluidly connected to the water.

10. The bidet device according to claim 9, wherein the first liquid is at least one of a deodorizing liquid or a cleaning liquid.

11. The bidet device according to claim 9, further comprising a second liquid inlet configured to be connected to a second container containing a second liquid, the second liquid inlet being fluidly connected to a second liquid nozzle for spraying the second liquid into the toilet.

12. The bidet device according to claim 11, comprising a cylindrical portion with a plurality of nozzles arranged around a circumference thereof, wherein the plurality of nozzles is configured to spray the second liquid into the toilet, and wherein the first liquid nozzle extends from a base of the cylindrical portion.

13. The bidet device according to claim 11, wherein the first liquid is a deodorizing liquid and the second liquid is a cleaning liquid.

14. The bidet device according to claim 9, further comprising a second wash nozzle for spraying water so as to wash a user's second body part, the second wash nozzle being fluidly connected to the water inlet, wherein the first wash nozzle is a rear wash nozzle and the second wash nozzle is a front wash nozzle.

15. A bidet device comprising:

a cylindrical portion;

a deodorizing mechanism, the deodorizing mechanism comprising:

a first container for a first liquid;

a first pump fluidly connected to the first container;

a deodorizing nozzle fluidly connected to the first pump, wherein the deodorizing nozzle extends downward from the cylindrical portion; and a first button coupled to the first pump, wherein pressing the first button activates the first pump; and a cleaning mechanism, the cleaning mechanism comprising:

a second container for a second liquid;

a second pump fluidly connected to the second container;

a plurality of nozzles spaced around the cylindrical portion, the plurality of nozzles being fluidly connected to the second pump; and a second button coupled to the second pump, wherein pressing the second button activates the second pump.

16. The bidet device of claim 15, further comprising an arm, the arm comprising:

a first passageway fluidly connected to the first pump and the deodorizing nozzle; and a second passageway fluidly connected to the second pump and the plurality of nozzles.

17. The bidet device of claim 15, wherein the deodorizing nozzle is angled such that it angles toward the front of a toilet when the bidet device is attached to the toilet.

18. A bidet device for attachment to a toilet, comprising:

a body;

a dial for operating the bidet device;

a nozzle housing extending downwards from the body;

a water inlet configured to be connected to a water supply line;

a first wash nozzle extending downwards from the nozzle housing, the first wash nozzle being fluidly connected to the water inlet;

a second wash nozzle extending downwards from the nozzle housing, the second wash nozzle being fluidly connected to the water inlet;

an arm extending downwards from the nozzle housing;

a cylindrical portion attached to the arm, the cylindrical portion comprising a plurality of nozzles spaced around the cylindrical portion;

a first inlet, the first inlet fluidly connected to the plurality of nozzles; and a first container for a first liquid.

19. The bidet device of claim 18, further comprising:

a pump, the pump fluidly connected to the first inlet and the plurality of nozzles; and a button connected to the pump, wherein pressing the button causes the pump to draw the first liquid from the first container and expel the first liquid from the plurality of nozzles.

20. The bidet device of claim 18, further comprising:

a nozzle extending from a base of the cylindrical portion;

a second inlet, the second inlet fluidly connected to the plurality of nozzles; and a second container for a second liquid.

21. The bidet device of claim 20, further comprising:

a pump, the pump fluidly connected to the second inlet and the nozzle; and a button connected to the pump, wherein pressing the button causes the pump to draw the second liquid from the second container and expel the second liquid from the nozzle.

* * * * *